US005986358A

United States Patent [19]

Hsieh

[11] Patent Number: 5,986,358

[45] Date of Patent: Nov. 16, 1999

[54] REMOTELY CONTROLLABLE WALL SWITCH

[75] Inventor: Yuan-Tai Hsieh, Tainan Hsien, Taiwan

[73] Assignee: Gen-Home Technology Co. Ltd., Tainan Hsien, Taiwan

[21] Appl. No.: 09/115,611

[22] Filed: Jul. 15, 1998

[51] Int. Cl.[6] ..... H01H 36/00

[52] U.S. Cl. ..... 307/117; 307/126

[58] Field of Search ..... 307/113, 114, 307/116, 117, 125, 126

[56] References Cited

U.S. PATENT DOCUMENTS

| | | | |
|---|---|---|---|
| 3,794,888 | 2/1974 | Hisano | 317/150 |
| 3,928,737 | 12/1975 | Prasert | 200/51 |
| 4,367,510 | 1/1983 | Watanabe | 361/160 |
| 4,377,754 | 3/1983 | Thompson | 307/114 |
| 4,686,380 | 8/1987 | Angott | 307/125 |
| 5,036,214 | 7/1991 | Zerillo | 307/140 |
| 5,340,954 | 8/1994 | Hoffman et al. | 200/277.2 |
| 5,818,128 | 10/1998 | Hoffman et al. | 307/116 |

*Primary Examiner*—Jeffrey Gaffin
*Assistant Examiner*—Ed Garlepp
*Attorney, Agent, or Firm*—Rosenberg & Klein

[57] ABSTRACT

A remotely controllable wall switch includes a housing, a push button and a receiver contained in the housing, and a transmitter. The receiver has a circuit board connected to two lead wires of a power source and a load and the push button. A lead wire of the power source and the load are connected to each other. In use, the push button of the receiver or a press key of the transmitter is pressed to control the receiver, to connect power to the load or disconnect it.

8 Claims, 9 Drawing Sheets

REMOTELY CONTROLLABLE WALL SWITCH

BACKGROUND OF THE INVENTION

This invention relates to a remote controllable wall switch, particularly to one provided with a remote receiver controlled by a remote transmitter for turning on and off a wall switch connected to a load such as a lamp.

To date, remote controllers have been widely used for controlling various electric appliances, such as televisions, air conditioners, fans, acoustic amplifiers, etc. But hanging lamps, wall lamps and computers are still generally controlled manually, without a remote controller.

SUMMARY OF THE INVENTION

This invention has been devised to offer a kind of remote controllable wall switch, provided with a push button and a receiver in its housing. The circuit boards of the receiver are respectively connected to two wires from the power source, the load, and the press button. One wire from the power source is connected to that of the load. In use, the press button or a press key of a transmitter is pressed to control the receiver to connect or disconnect the power source to the load, which is then turned on or off.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
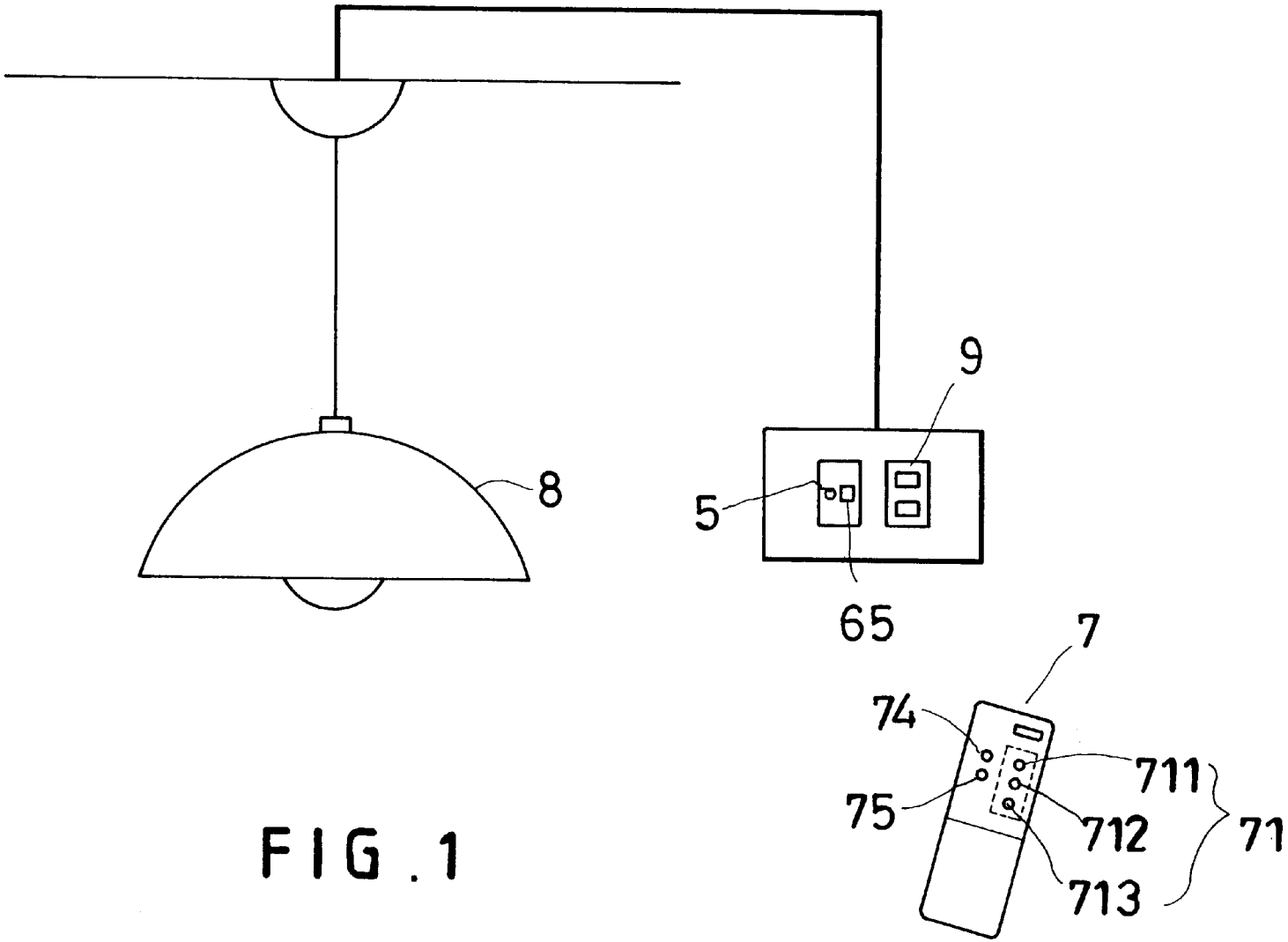
FIG. 1 is a schematic representation of a remote controllable wall switch of the present invention.
Figure 2:
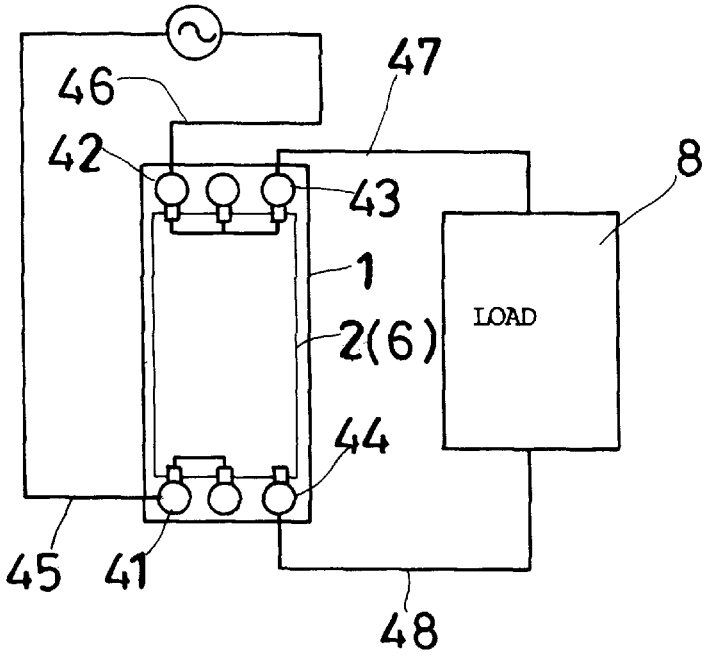
FIG. 2 is a wire connection diagram of a power source and a load of the present invention.

A preferred embodiment of a remote controllable wall switch of the present invention, as shown in FIGS. 1 and 2, includes a housing 1, a push button 5 and a receiver 6 both contained in the housing 1.

The receiver 6 has circuit boards respectively connected to a power source and a load 8 (such as a lamp) with wires 45–48 and to the push button 5. The wire connections 42 and 43 between the power source and the load 8 are connected to each other via the circuit board. In use, the push button 5 or the press key 71 of a transmitter 7 are pressed to control the receiver 6, connecting or disconnecting the coupling between the lead wire connectors 41 and 44 between the power source and the load 8, to turn on or off the load 8.

Figure 4:
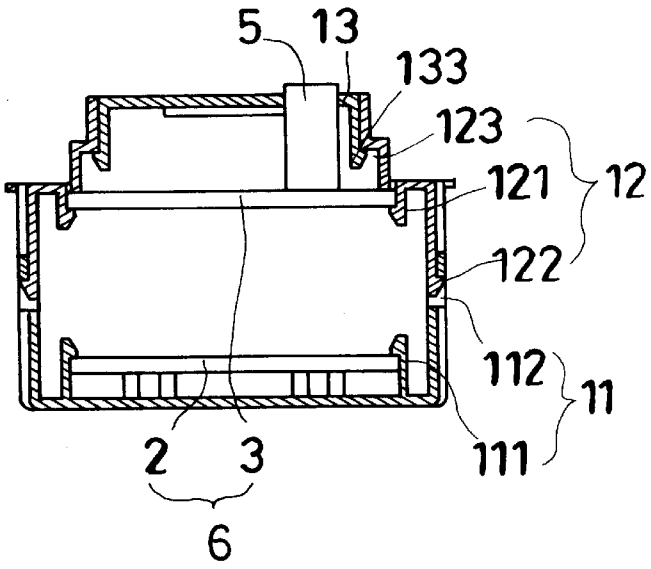
FIG. 4 is a cross-sectional view of the housing combined with two circuit boards of the receiver of the present invention.
Figure 3:
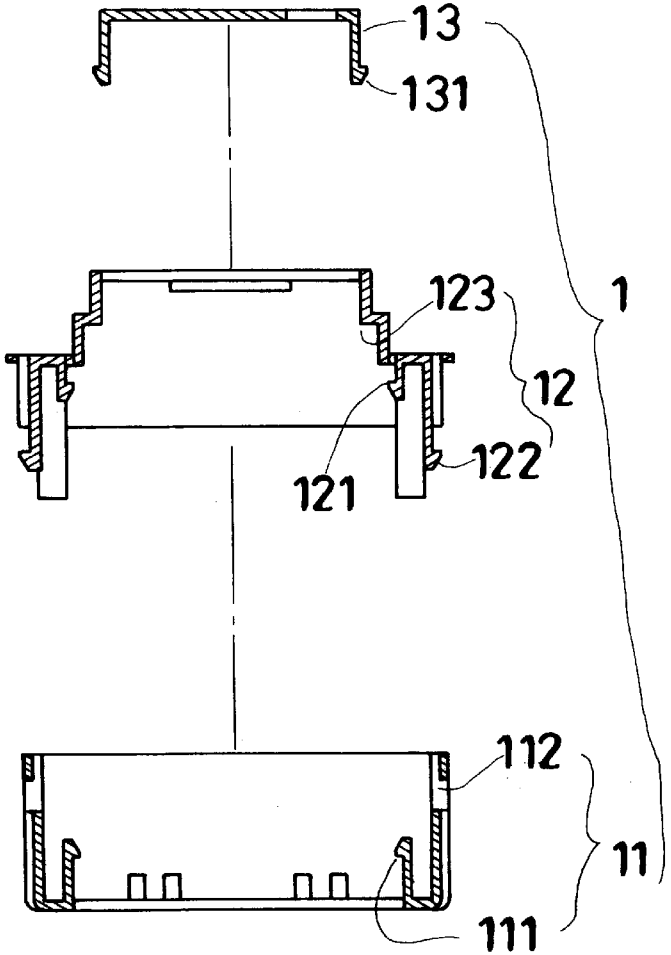
FIG. 3 is an exploded cross-sectional view of a housing of the present invention.
Figure 6:
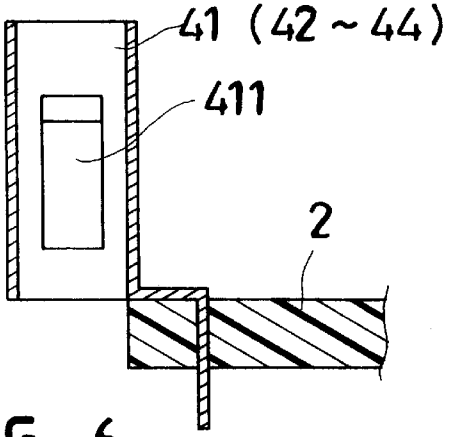
FIG. 6 is a cross-sectional view of a conductor combined with a circuit board of the present invention.

The housing 1 is as large as a common wall switch of standard size. Referring to FIGS. 3 and 4, the housing 1 consists of a base 11, a middle housing 12 and an upper cover 13. The base 11 has a plurality of upright studs 111 for holding pinchingly the first circuit board 2 of the receiver 6. The middle housing 12 has a plurality of upright projections 121 for holding pinchingly a second circuit board 3 of the receiver 6. The first and the second circuit boards 2 and 3 are connected to each other with wires. The base 11 has a hole 112 respectively in an upper portion of two opposite side walls to fit engaging projections 122 formed at a lower end of two opposite side walls of the middle housing 12. The middle housing 12 has a step-shaped section 123 respectively formed in an upper portion of two opposite walls for engagement with projections 131 respectively formed at a lower end of two opposite side walls of the upper cover 13.

Figure 7:
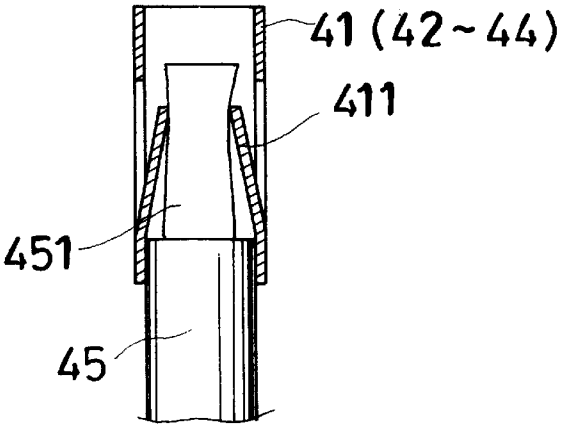
FIG. 7 is a cross-sectional view of a conductor connected to a lead wire of the present invention.
Figure 5:
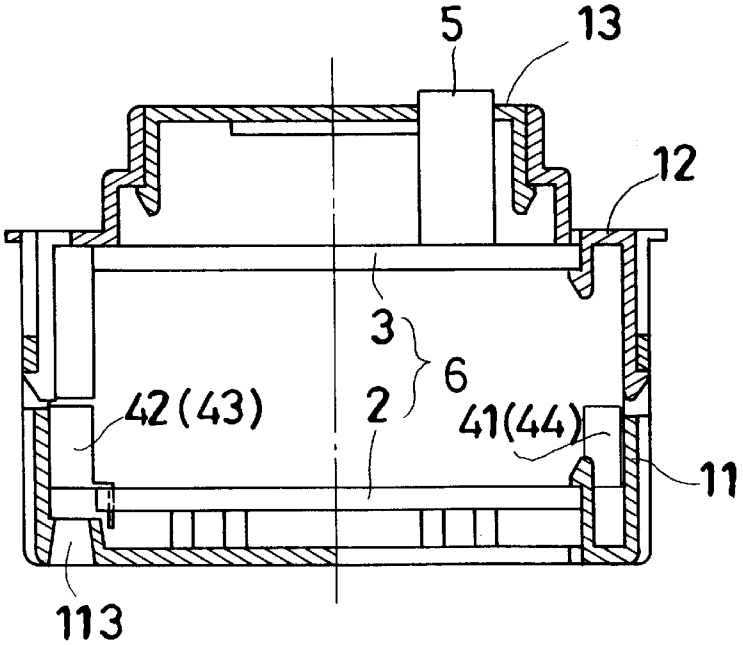
FIG. 5 is another cross-sectional view of the housing combined with the circuit boards of the receiver of the present invention.

The first circuit board 2 of the receiver 6 shown in FIG. 5, has a plurality of conductor connectors 41, 42, 43, and 44, and the base 11 has a plurality of holes 113 in respective alignment with the conductor connectors 41–44 for lead wires 45, 46, 47, and 48 of the power source and the load 8 to respectively pass through and firmly contact the conductor connectors 41–44. As shown in FIG. 7, the conductor connector 41 is cylindrically shaped for receiving the lead wire 45 therein, and two opposing elastic pieces 411, cut from the tubular wall, elastically pinch a bare metal end 451 of the wire 45. The other conductors 42, 43, and 44 are done in the same way.

The second circuit board 3 of the receiver 6, as shown in FIG. 4, has the push button 5 welded thereon, and the push button 5 protrudes up through the upper cover 13 for depression by a user.

An infrared beam can be passed through the upper cover 13, but visible light cannot pass therethrough. So, the transmitter 7 can control the receiver 6 with an infrared beam.

The conductor connectors 42 and 43 of the first circuit board 2 are always connected to each other, as shown in FIG. 2. Therefore, the wires 46 and 47 of the power source and the load 8 are always connected to each other. The other two conductor connectors 41 and 44 are connected to the circuit. When the push button 5 or the press key 71 of the transmitter 7 is pressed down, the conductor connectors 41 and 44 become connected to each other, with the power from the power source supplied to the load 8.

Figure 8:
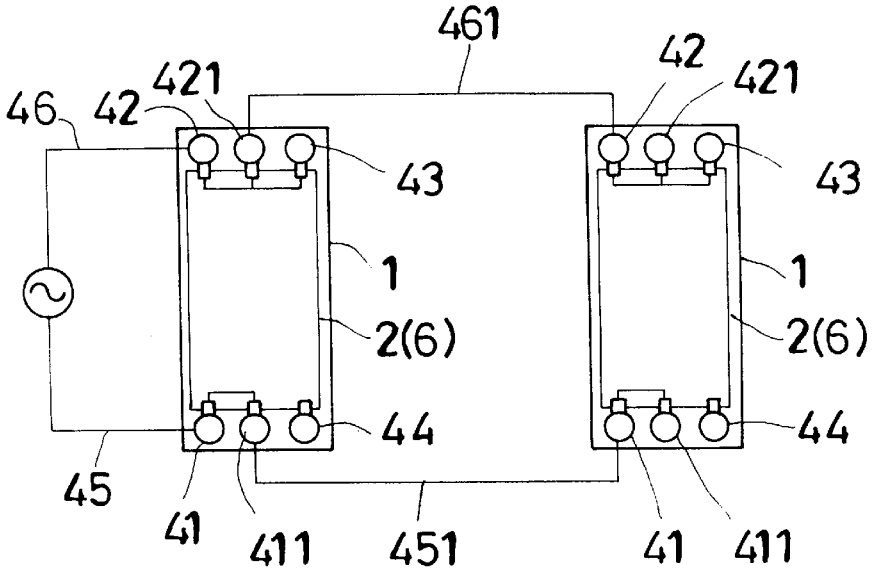
FIG. 8 is a wire connecting diagram of two wall switches commonly connected to the power in parallel of the present invention.

As shown in FIG. 8, the first circuit board 2 of the receiver 6 has two conductor connectors 411 and 421 welded thereon and respectively connected to two wires 45 and 46 respectively connected to the power source. If another wall switch is to be connected to the conductor connectors 41 and 42, the conductor connectors 41 and 42 may be connected to the two conductor connectors 411 and 421, respectively, with lead wires 451 and 461 to couple power thereto. Thus, two wall switches receive power by means of simple connection. The two conductor connectors 411 and 421 have the same structure as the aforesaid conductor connectors 42–44.

Figure 9A:
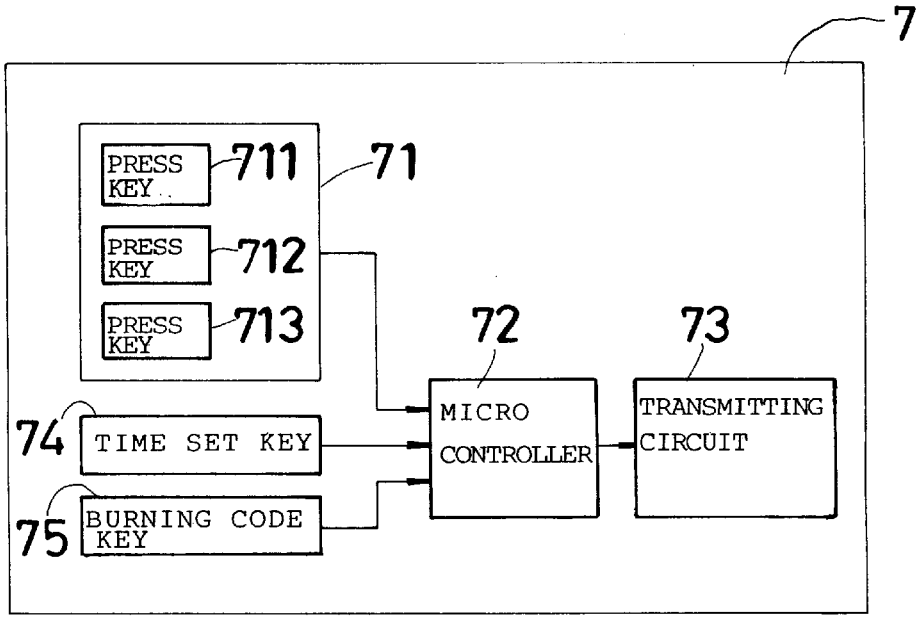
FIGS. 9A and 9B are respective block diagrams of the circuit of the transmitter and the receiver of the present invention.
Figure 9B:
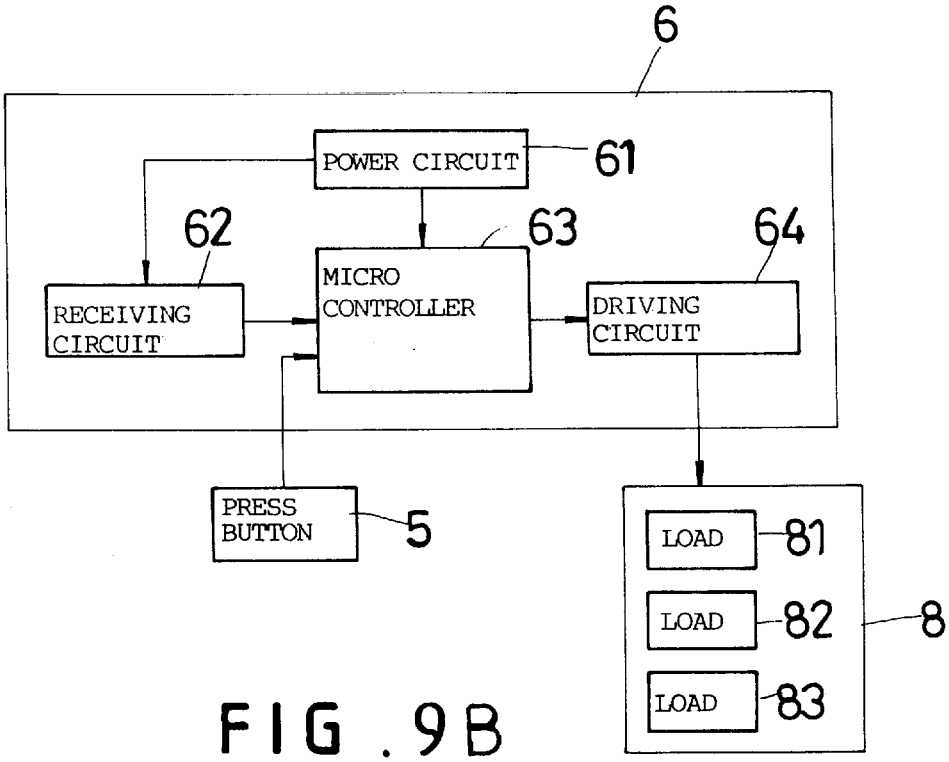
Figure 10:
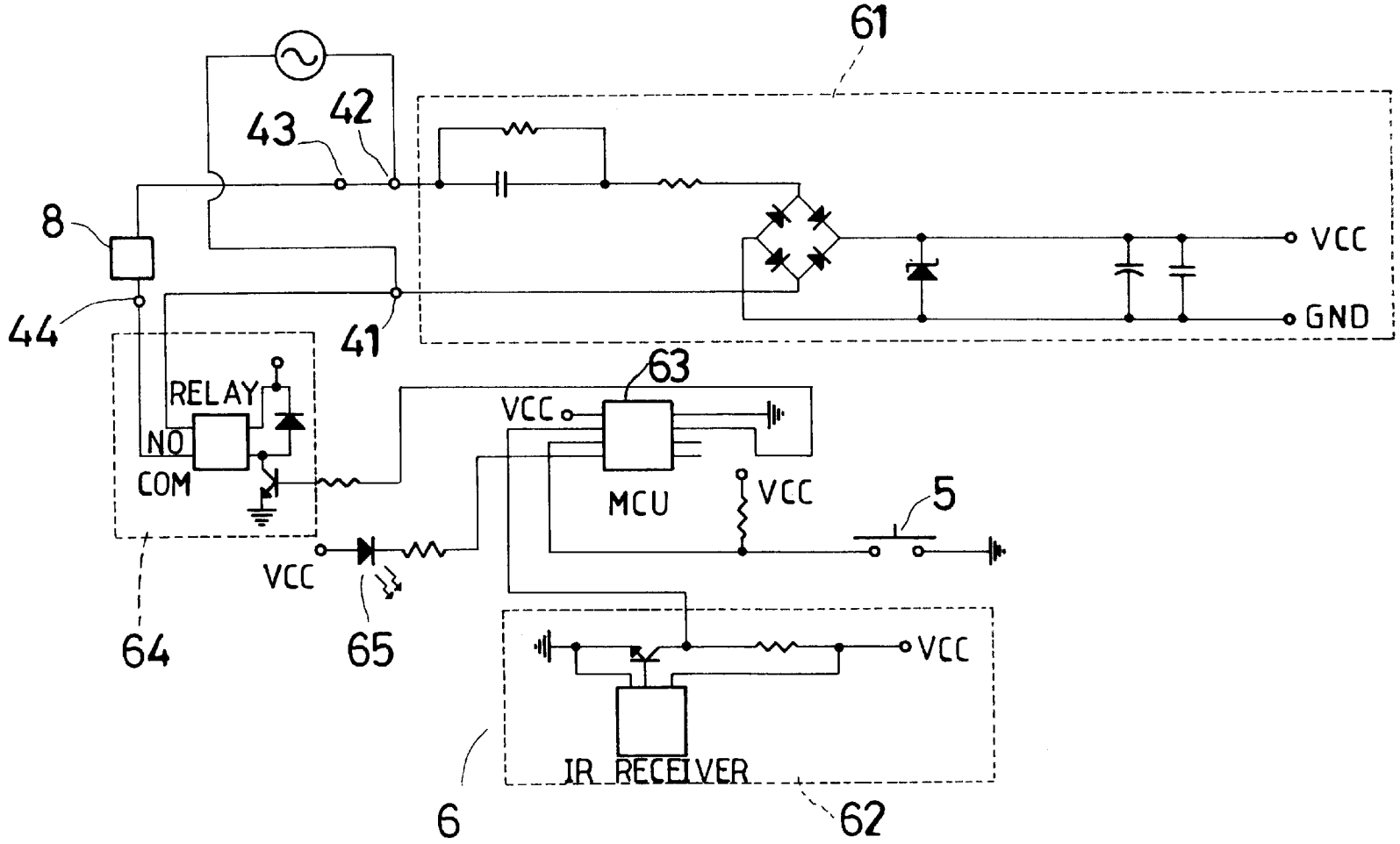
FIG. 10 is a circuit diagram of the receiver of the present invention.

The receiver 6, as shown in FIGS. 2, 9B and 10 includes a power circuit 61, a receiving circuit 62, a micro controller 63, and a driving circuit 64.

The power circuit 61 has two inputs connected to the two conductor connectors 41 and 42, and also connected to two wires 45 and 46 from the power source, supplying DC power rectified from AC power, to the various circuits of the receiver 6.

The receiving circuit 62 is an IR (infrared) receiver module, for receiving preset carrier signals from a transmitter 7. The signals are then fed to the micro controller 63 for decoding, to trigger or not trigger the driving circuit.

The driving circuit 64 is a relay having two terminals, N.O. and COM, respectively connected to the conductor connections 41 and 44 and also connected to the lead wires 45 and 48 for the load 8, for coupling or not coupling power to the load 8.

The micro controller 63 has an input port connected to the push button 5, to thereby control the driving circuit 64. Further, the micro controller 63 has an anti-contact bounce program for preventing a wrong action caused by snapping of the push button 5. In other words, when the push button 5 is pressed down, it may produce a contact bounce produced oscillating pulse. When the micro controller 63 receives the first pulse signal, it immediately responds to the driving circuit 64, and counts a certain time (about 0.1 s). After that time, the micro controller 63 senses the input port connected to the push button 5, avoiding the unsteady oscillating pulse signal from contact bounce. Further, the micro controller 63, as shown in FIGS. 1 and 10, has an output port connected to an indicator 65 (such as an LED), and with coordination of its program, it lights up the indicator 65 when the load 8 is not energized, for indicating its location in the dark.

Next, referring to FIGS. 1 and 9A, the transmitter 7 includes a press key 71, a micro controller 72 having an input port connected to the press key 71 and an output port connected to a transmitting circuit 73. When the press key 71 is pressed down, the micro controller 72 outputs coded signals that are transmitted through an infrared diode of the transmitting circuit 73. Further, if the press key 71 is pressed without release, under control of the program of the micro controller 72, the transmitting circuit 73 produces several (2 or 3) cycles of coded signals and then stops, without the necessity of releasing the press button 71 to stop output of the signals. Consequently, the transmitting power may be increased and the transmitting distance prolonged, with an increased lifetime of the infrared diode of the transmitting circuit 73. The total time for transmitting coded signals by the transmitting circuit 73 is Ta, and the delayed time of turning on the load 8 after the receiver 6 receives the preset coded signal is Tb, and then Tb>Ta.

In use, the push button 5 can be manually pressed down by a user, and the micro controller 63 receives a signal therefrom and triggers the driving circuit 64, with the conductor connector 41 being connected to the conductor connector 44 to send power to the load 8, which is thereby energized at once. Then, pressing the push button 5, once more, permits the micro controller 63 to sense operation of the push button 5, in association with the receiving circuit 62, and stop triggering the driving circuit 64. The power supplied to the load will be cut off at once, and the indicator 65 will be illuminated.

Instead of using the push button 5, the press key 71 of the transmitter 7 can be pressed to turn on and off the wall switch in a remote control mode. A preset coded carrier signal is produced by the transmitter 7 and transmitted to the receiver 6 in the wall switch. Then the receiving circuit 62 of the receiver 6 receives the transmitted signal and micro controller 63 decodes it. If the transmitted signal turns out to be the correct signal transmitted by the transmitter 7, the micro controller 63 triggers the driving circuit 64, which at once permits the power to be coupled to the load 8. When the press key 71 of the transmitter 7 is pressed once again, and the receiver 6 receives and decodes the signal from the transmitter 7, the micro controller 63 then no longer triggers the driving circuit 64. Then, the driving circuit 64 de-energizes the load 8 and energizes the indicator 63.

Figure 11:
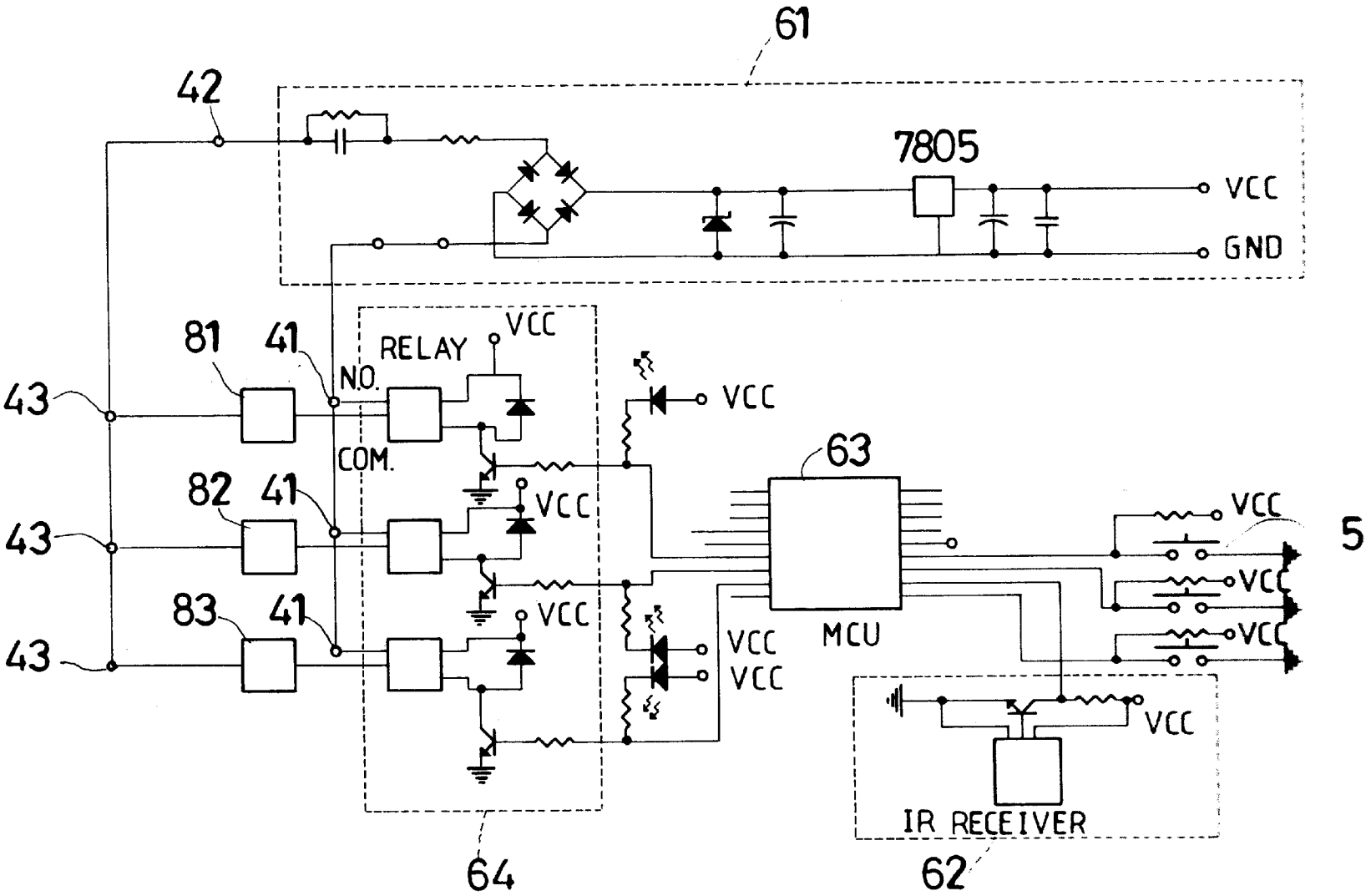
FIG. 11 is a circuit diagram of the receiver controlling a plurality of loads of the present invention.

The micro controller 63 of the receiver 6 may be used with several wall switches for controlling several loads 81, 82, and 83, as shown in FIGS. 9B and 11. Several output ports of the micro controller 63 of the receiver 6 are respectively connected to the driving circuits 64 of several wall switches so as to control turning on and off the wall switches. Each driving circuit 64 has its two connect points respectively connected to the conductor connectors 41 and 44 to control coupling of power to the loads 81, 82, and 83. Accordingly, the transmitter 7 is provided with several press keys 711, 712, and 713. In association with operation of the micro controller 72 and the transmitting circuit 73, various preset coded signals are transmitted to control the wall switches via the receiver 6. Thus, only a single transmitter 7 can control a plurality of loads 81, 82, and 83.

The remote controllable wall switch can also be provided with the function of turning on and off a load 8 at a preset time, by providing a time set key 74 of the transmitter 7, in association with operation of the micro controller 72 and the transmitting circuit 73. Then, the time for turning on and off the load 8 may be set and a coded signal will be transmitted at the preset time. When the receiver 6 receives the coded signal, the micro controller 63 decodes the coded signal and intermittently triggers the indicator 65 at the output port to flicker. Further, the micro controller 72 counts time until the preset time is reached. Then, the micro controller 63 turns on or off the driving circuit 64 to energize or de-energize the load 8.

For example, coded signals transmitted by the transmitter 7 may include customer codes, distinguish codes, and information codes, wherein a distinguish code representing 00 represents a normal condition, and 01 represents a preset time condition. Information codes represent codes for each of the loads 81, 82, and 83. For example, 001 designates the load 81, 101 designates the load 82, and 011 designates the load 83. If the load 81 is to be turned on, a press key 711 of the transmitter 7 is pressed, and the transmitted coded signals of the customer code, the distinguish code and the information code are respectively xxx, 00, 001. If the load 8 is to be turned on 40 minutes from the current time, the time set key 74 of the transmitter 7 and the press key 711 controlling the load 8 are pressed synchronously, then the coded signals of the customer, the distinguish code and the information code transmitted by the transmitter 7 are respectively xxx, 01, 001. Then, when the receiver 6 receives the transmitted signals, it triggers the indicator 65 to flicker, which means that the transmitter 7 and the receiver 6 are in a preset time mode. At the same time, the program of micro controller 72 of the transmitter 7 alters the function of keys 711, 712, and 713 into keys for setting time. For example, the key 711 corresponds to 20 minutes, the key 712 corresponds to 40 minutes, and the key 713 corresponds to an hour. So if a user presses the key 712, the customer code of a transmitted coded signal would be altered to 101, intending the time setting for maintaining energization of the load 8 for 40 minutes. So the receiver 6 in association with the operation of the micro controller 63 energizes the load for 40 minutes. After the timer is set, the load 8 turns on and off once, and the indicator 65 flickers twice to represent the 40 minute time span of the second stage of timer setting. Further, if the time setting function is to be canceled, the push button or the key 711 can be used to alter it into the common remote control function.

Next, referring to FIGS. 1 and 9A, the remotely controllable wall switch can respond to a function for storage of a code transmitted through the air. With the microcontroller 63 of the receiver 6 presetting a code for the load 8, to be remotely controlled, the transmitter 7 also adds the identify code to its coded signals. The receiver 6 then identifies the control code of the load 8. But, while a user who has two wall switches of the same substitute code for controlling two loads 81 and 82, presses the key 711 of the transmitter 7, the two loads 81 and 82 will be driven at the same time, resulting in an improper operation. Therefore, a storage code function is needed to set different codes for the two different loads 81 and 82. So a storage code key 75 is additionally connected to an input port of the micro controller 72 of the transmitter 7 to perform the code storage operation through the air.

The coded signals output by the transmitter 7 include the customer code, the distinguish code and the information code. The information code is the individual identification code for the load. If the distinguish code is 00, it represents the normal condition, and if it is 10, it represents the code storage condition. For example, if the customer code is xxx, and the information code is to be 001 for the load 81, the coded signal of the transmitter 7 through the key 711 is xxx00001. If the information code for the switch controlling the load 81 and the information code for the switch controlling the load 82 are the same, 001, the user can alter the information code of the switch controlling the load 82 to be a different information code, for example, 010, to separately control the respective switches controlling the two different loads 81 and 82.

In operation, if the information code for the switch controlling load 81 is not to be changed, it must be turned off. Then, the switch controlling the load 81 will ignore the transmission of the storage code function. If the information code of the switch controlling the load 82 is to be altered, the switch controlling the load 82 must be turned on. Next, the storage code key 75 is pressed continuously. Then, the control key 712 is pressed for the new information code which is to be entered, thereby completing the storage code function. If the distinguish code is 10, then the transmitted code signal will be xxx10010.

When the micro controller 63 of the receiver 6 identifies that the distinguish code is 10, it will automatically alter the information code of the switch controlling the second load 82, altering the original information code 001 to 010. Then the two loads 81 and 82 can be controlled by the keys 711 and 712, respectively.

Figure 12:
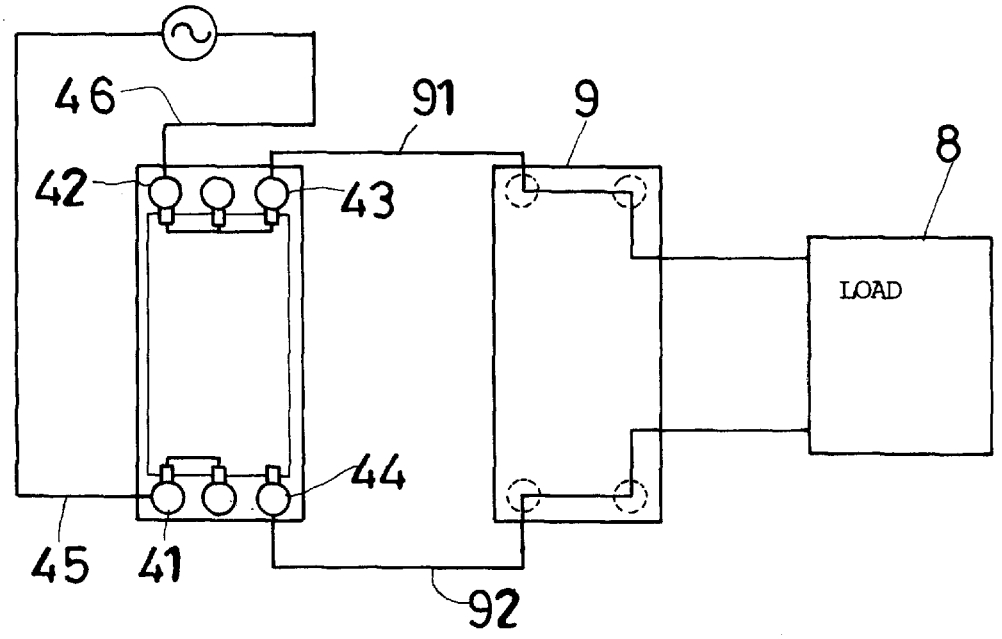
FIG. 12 is a wire connecting diagram of a wall receptacle connected to a circuit board of a receiver of the wall switch of the present invention.

Next, referring to FIGS. 1 and 12, if the load 8 needs to get power by means of a plug inserted into a receptacle 9, fixed on a wall, two lead wires 91 and 92 of the receptacle 9 are respectively connected to the conductors 43 and 44 of the circuit board of the receiver 6 of the wall switch. Wires 46 and 91 of the power source and the receptacle 9, respectively, are connected to each other via the circuit board. In use, pressing the button 5 or the key 71 connects or disconnects the other lead wires 45 and 92 of the power source and the receptacle 9.

Figure 15:
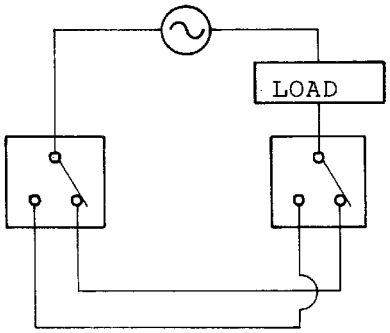
FIG. 15 (PRIOR ART)
Figure 14:
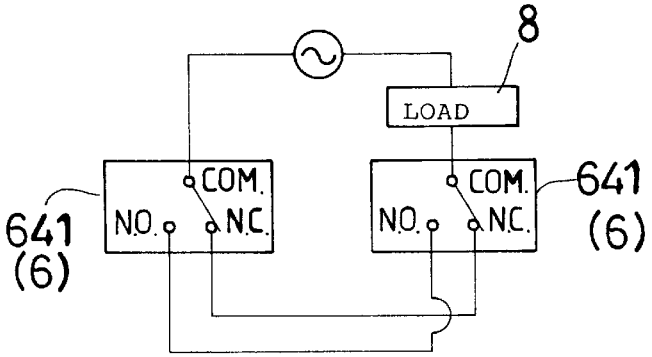
FIG. 14 is a wire connecting diagram of the single pole double throw switch of the present invention; and, FIG. 15 is a wire connecting diagram of two conventional single pole double throw switches.
Figure 13:
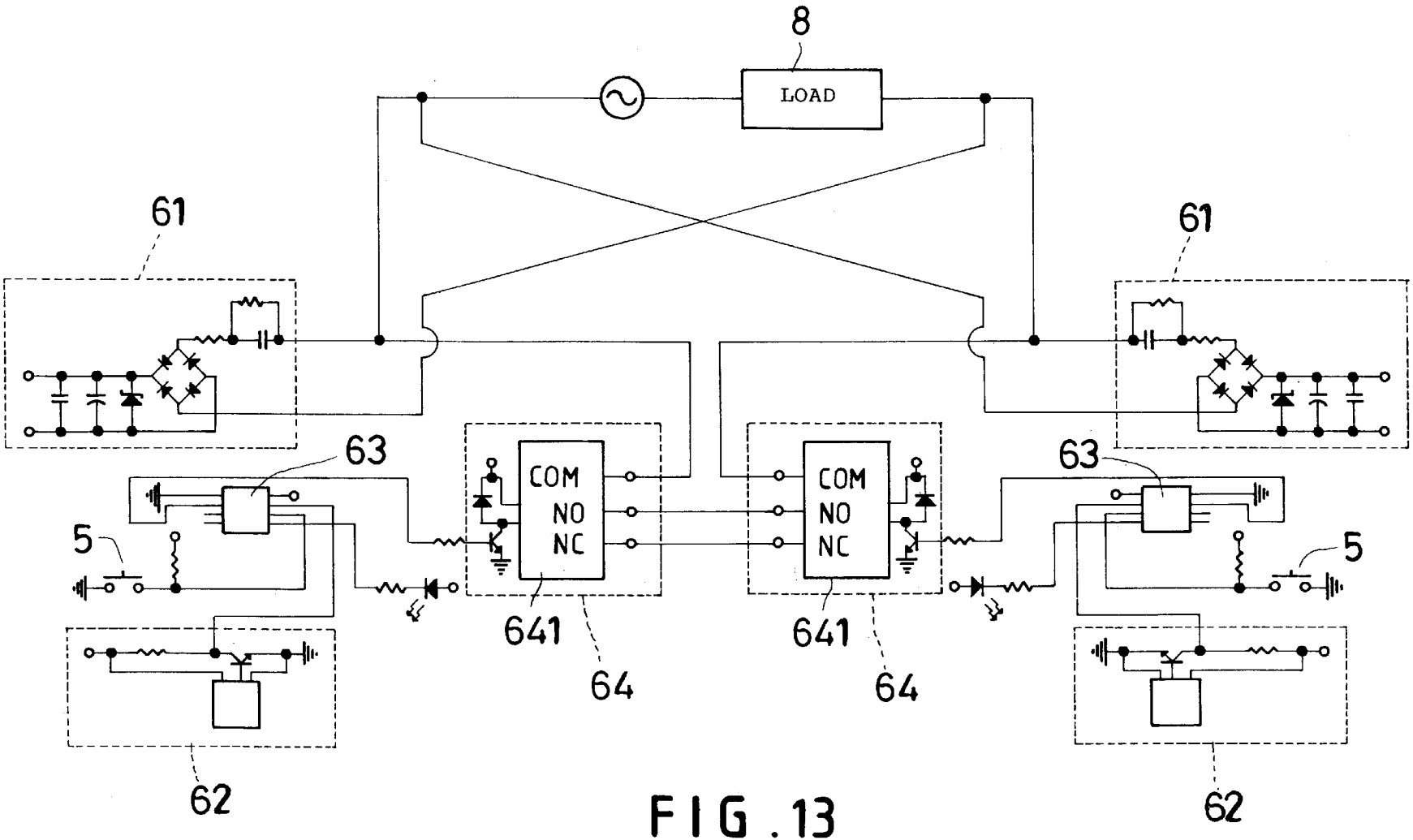
FIG. 13 is a circuit diagram of a single pole double throw switch used as a remotely controllable wall switch of the present invention.

FIG. 15 shows a common single pole double throw switch (SPDT) connected to the power source and the load. A SPDT is often used for controlling a stairway lamp. This invention offers an embodiment using SPDT switches, utilizing two wall switches for commonly controlling a single load 8. Referring to FIGS. 13 and 14, the output port of the receiver 6 is connected to the driving circuit 64, that is in-turn connected to the power source and the load 8. When the button 5 or the key 71 is pressed to control the receiver, it enables the driving circuit 64 to form a completed circuit or to disconnect the load 8 from the power source, to energize the load 8, or not. The driving circuit 64 is a relay circuit 641, having one terminal connected to the power source or the load 8, the common terminal (COM) being respectively connected to a terminal of the power source or the load 8. Further, the normally open terminals (N.O.) of the two relays 641 are connected to each other, and the normally closed terminals (N.C.) are also connected to each other. Thus, the remotely controllable SPDT switches can be used to commonly control a single load which is connected to the two wall switches.

As can be understood from the aforesaid description, this invention has the following advantages.

1. It can not only retain the original function of manual operation, but also has a remote control function to connect power to the load.

2. It has a receiver contained in its housing, making its dimensions as small as common wall switches. It has a standard size and is able to be contained in a standard circuit box (the smallest circuit box is NO. 3 size), taking up a very small space.

3. The receiver can be contained in a wall switch, not affecting the outer appearance of the switch.

4. Its housing is easily taken apart and assembled, which is advantageous for manufacturing, maintenance and repair.

5. Common remote controllers using an infrared beam will transmit infrared rays continuously, if one of its buttons is pressed and held, consuming a lot of battery power. In addition, its emitting power cannot be increased, and therefore it is unable to emit over a long distance. The present invention has none of the aforesaid drawbacks, automatically stopping transmitting action after giving out a few cycles of the output signals, even if the key of the transmitter is continuously pressed. Thus, the present invention can save battery power, increase transmitting power to prolong its transmitting distance, and prevent the infrared diode from burning up.

6. It has a remote controlled time setting function turning on and off the load.

7. It has a function for storing a code transmitted through the air, so that different codes can be utilized for controlling different loads, separately. Whereas, a conventional method used for remote controlling different electric appliances is to use different circuit layouts or to change the software program thereof, to alter the coded signals, which is too troublesome for consumers. The present invention, however, can store a code transmitted through air by operating the transmitter, to alter coded signals whenever needed.

8. It does not matter whether a load gets power through a plug inserted into a receptacle, or directly through lead wires, the load can be controlled by the present invention.

9. The present invention can be used as a remotely controllable single pole double throw switch.

What is claimed is:

1. A remotely controllable wall switch for selectively energizing and de-energizing a load, comprising:

a portable transmitter, said portable transmitter including a first micro-controller, a plurality of press keys respectively coupled to inputs of said first micro-controller, and a transmitting circuit transmitting at least one of plurality of infrared code signals responsive to respective operation of at least one of said plurality of press keys; and, a receiver mounted in a housing for receiving said coded signals, said housing being secured within an electrical junction box, said receiver including, (a) a second micro-controller, (b) a circuit for receiving said infrared coded signals having an output coupled to said second micro-controller, (c) a push button coupled to an input of said second micro-controller, (d) at least one driving circuit coupled to an output of said second micro-controller, said driving circuit having an input coupled to a lead from a power source and an output coupled to the load for controlling connection and disconnection of power to the load responsive to selected operation of (i) said push button or (ii) one of said plurality of press keys, (e) at least one indicator coupled to an output of said second micro-controller, said second micro-controller energizing said indicator responsive to the load being in a de-energized state.

2. The remotely controllable wall switch as recited in claim 1 where said second micro-controller includes means for operating in a timed mode where at least one of said connection and said disconnection of power to the load is performed in accordance with selected time periods transmitted by said portable transmitter.

3. The remotely controllable wall switch as recited in claim 2 where said first micro-controller includes means for output of signals to said receiver for establishing said timed mode responsive to operation of one of said plurality of press keys and for defining predetermined time period codes associated with operation of other of said plurality of press keys for transmission to said receiver.

4. The remotely controllable wall switch as recited in claim 1 where said second micro-controller includes information code means for responding to said infrared code signals output from said transmitter having a predetermined information code, said first micro-controller including means for output of signals to said receiver for modifying said information code means to respond to a new information code responsive to operation of another of said plurality of press keys and for defining said new information code associated with operation of another of said plurality of press keys for transmission to said receiver.

5. A remotely controllable wall switch for selectively energizing and de-energizing a plurality of individual loads, comprising:

a portable transmitter, said portable transmitter including a first micro-controller, a plurality of press keys respectively coupled to inputs of said first micro-controller, and a transmitting circuit transmitting coded signals corresponding to operation of at least one of said plurality of press keys; and, a receiver mounted in a housing for receiving said coded signals, said receiver including, (a) a second micro-controller, (b) a circuit for receiving said coded signals having an output coupled to said second micro-controller, (c) a plurality of push buttons coupled to an input of said second micro-controller and respectively corresponding to the plurality of individual loads, and (d) a plurality of driving circuits respectively coupled to an output of said second micro-controller, each of said plurality of driving circuits having an input coupled to a lead from a power source and an output coupled to a respective one of the plurality of individual loads for controlling connection and disconnection of power thereto responsive to selected operation of (i) one of said plurality of push buttons or (ii) one of said plurality of press keys, said transmitter transmitting said coded signals with an information code designating one of the plurality of individual loads responsive to said operation of said one press key.

6. A remotely controllable wall switch for selectively energizing and de-energizing a load, comprising:

a portable transmitter, said portable transmitter including a first micro-controller, a plurality of press keys respectively coupled to inputs of said first micro-controller, and a transmitting circuit transmitting at least one of plurality of code signals responsive to respective operation of at least one of said plurality of press keys; and, a receiver mounted in a housing for receiving said coded signals, said receiver including, (a) a second micro-controller, (b) a circuit for receiving said coded signals having an output coupled to said second micro-controller, (c) a push button coupled to an input of said second micro-controller, and (d) at least one driving circuit coupled to an output of said second micro-controller, said driving circuit having an input coupled to a lead from a power source and an output coupled to the load for controlling connection and disconnection of power to the load responsive to selected operation of (i) said push button or (ii) one of said plurality of press keys, said second micro-controller including means for operating in a timed mode where at least one of said connection and said disconnection of power to the load is performed in accordance with selected time periods transmitted by said portable transmitter, said first micro-controller including means for output of signals to said receiver for establishing said timed mode responsive to operation of another of said plurality of press keys and for defining predetermined time period codes associated with operation of other of said plurality of press keys for transmission to said receiver.

7. The remotely controllable wall switch as recited in claim 6 where said receiver includes at least one indicator coupled to an output of said second micro-controller, said second micro-controller energizing said indicator responsive to the load being in a de-energized state.

8. The remotely controllable wall switch as recited in claim 6 where said second micro-controller includes information code means for responding to said code signals output from said transmitter having a predetermined information code, said first micro-controller including means for output of signals to said receiver for modifying said information code means to respond to a new information code responsive to operation of another of said plurality of press keys and for defining said new information code associated with operation of another of said plurality of press keys for transmission to said receiver.

* * * * *